United States Patent [19]

Cheston

[11] Patent Number: 4,580,140

[45] Date of Patent: Apr. 1, 1986

[54] TWIN APERTURE PHASED ARRAY LENS ANTENNA

[75] Inventor: Theodore C. Cheston, Bethesda, Md.

[73] Assignee: The United States of America as represented by the Secretary of the Navy, Washington, D.C.

[21] Appl. No.: 505,570

[22] Filed: Jun. 17, 1983

[51] Int. Cl.[4] ..... H01Q 3/22; H01Q 3/24; H01Q 3/26

[52] U.S. Cl. ..... 343/372; 343/709; 343/754

[58] Field of Search ..... 343/368, 371, 372, 376, 343/754, 709

[56] References Cited

U.S. PATENT DOCUMENTS 3,430,242 2/1969 Safran .
3,971,022 7/1976 Lenz .
3,978,484 8/1976 Collier ..... 343/376

*Primary Examiner*—E. Lieberman
*Attorney, Agent, or Firm*—Robert F. Beers; William T. Ellis; Alan P. Klein

[57] ABSTRACT

A phased array lens antenna which includes a lens having two faces disposed substantially at a right angle to each other. Transmit-receive modules which include phase-shifters are shared between the two lens faces. Two lens antennas positioned in back-to-back relationship about a ship superstructure scan 360°.

16 Claims, 2 Drawing Figures

TWIN APERTURE PHASED ARRAY LENS ANTENNA

BACKGROUND OF THE INVENTION

The present invention relates generally to directive radar systems, and more particularly to steerable antenna arrays.

Phased arrays offer considerable flexibility to a radar system. With complete control of phase to every element of the aperture, the radar beam may be steered rapidly through a wide range of scan-angles. High data rates are available for adaptively interlaced functions including fire-control, surveillance and even communications. A phased array radar may interact freely with a multiplicity of targets under a variety of conditions and adjust its time allocations to give preference to the most pressing immediate needs. That phased arrays have not proliferated is due to their very high cost. With traditional phased arrays using high power tubes, typically about 30 to 40% of the total radar cost is accounted for by the antenna, mainly due to the cost of the phase-shifters, and about 40 to 50% of the cost is due to the transmitter.

With conventional phased arrays, shipboard applications present a problem because of obstructions caused by the superstructure.

SUMMARY OF THE INVENTION

It is therefore an object of this invention to form steerable antenna beams reliably, efficiently and cost-effectively.

Another object is to steer antenna beams from a ship through a complete hemisphere of coverage without having to look through the ship's superstructure.

These and other objects of the invention are achieved by a lens antenna which include a lens having a pair of faces disposed substantially at a right angle to each other but tilted back, a set of radiating elements on each of the faces which are adapted to form antenna beams when energized, and a feed system to energize the set of radiating elements.

Cost-effectiveness is obtained through the use of solid-state amplifying transmit/receive modules which include diode phase-shifters and which are shared between two corresponding radiating elements of adjacent lens faces. The solid-state modules form part of the interconnection of the two faces, giving transmit and receive amplification within the lens. Transmitters and phase-shifters typically account for up to 80% of the hardware cost of phased array radars. Sharing reduces these costs significantly. With distributed solid-state modules, power distribution losses are small, leading to high overall efficiency, and phase-shifter requirements are simplified; life cycle costs are reduced from those of conventional systems using vacuum tubes that have to be replaced periodically. Solid-state components are beginning to be readily available, at least in demonstration models, to S-through X-band. The system has the potential of wide bandwidth, high reliability, and can use methods for diagnostics and self grooming.

In another aspect, the invention involves the combination of two such lens antennas on the deck of a ship to scan 360° in azimuth. One lens antenna is positioned in front of the ship's superstructure and the other antenna is positioned behind the ship's superstructure in back-to-back relationship to the first antenna. Since each face of each lens gives a scan capability overlapping with those of the adjacent lens, this arrangement gives full hemispherical coverage without having to look through the ship's superstructure.

Additional advantages and features will become apparent as the subject invention becomes better understood by reference to the following detailed description when considered in conjunction with the accompanying drawings wherein:

DESCRIPTION OF THE PREFERRED EMBODIMENT

Figure 1:
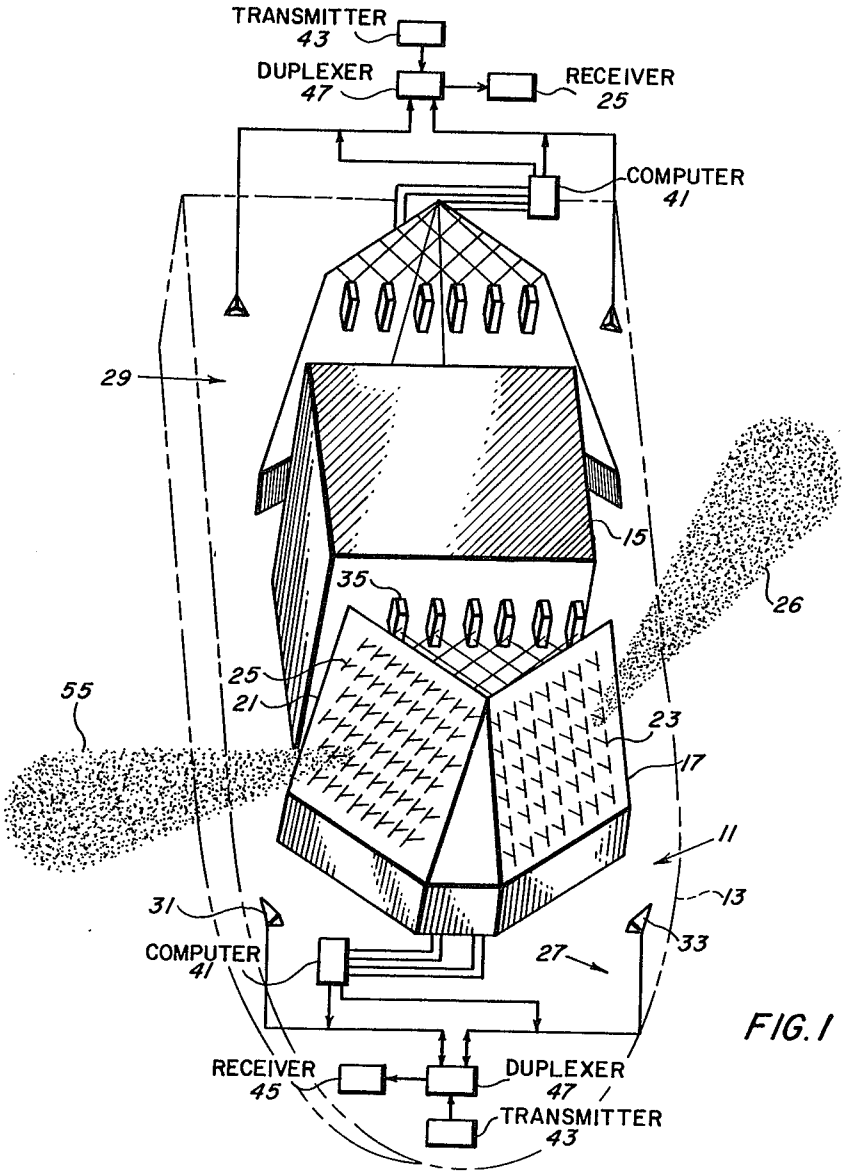
FIG. 1 is a diagrammatic view of the lens antenna of this invention.

FIG. 1 shows a lens antenna 11 suitable for deployment on the deck of a ship 13 having a superstructure 15 which obstructs the field-of-view. The lens antenna 11 includes a lens 17 positioned in front of the ship's superstructure 15. The lens 17 has a pair of faces 21 and 23 disposed substantially at a right angle to each other but tilted back for better vertical coverage. A set of radiating elements 25 is disposed on each face and each set is adapted to form antenna beams (e.g. 26) in a quadrant of space when energized. A feed system 27 energizes the sets of radiating elements 25. To scan 360° in azimuth, a second lens antenna 29, identical to the first, is positioned behind the superstructure 15 in back-to-back relationship with the first lens antenna 11. Since each face of each lens gives a scan capability overlapping with those of the adjacent lens, this arrangement gives full hemispherical coverage without having to look through the ship's superstructure 15.

For ease of description, the structure and operation of the invention will be described hereinafter with reference to antenna 11 alone, since the two antennas 11 and 29 are identical.

The feed system 27 may comprise, for example, a pair of feed horns 31 and 33. One feed horn is disposed adjacent each face of the lens 17 for energizing the respective set of radiating elements 25. An array of modular means 35 interconnects the radiating elements 25 on one face (e.g. 21) of the lens with the radiating elements on the other face (e.g. 23) of the lens. The array of modular means 35 responds to the energizing of the radiating elements 25 on one of the faces (e.g. 21) by collecting the energy from the radiating elements and feeding it to the radiating elements on the other face (e.g. 23).

It is to be noted that the configuration of the faces of the lens 17 is such that behind the faces 21 and 23 there is a natural surface for mounting the array of modular means 35. This surface is readily accessible for repairs and replacements, and has ample space for prime power supply leads and for an effective cooling system to remove the heat generated by the power supply.

Each modular means 35 includes a controllable phase-shifter 37 (shown in FIG. 2) for causing an antenna beam (such as 26) formed by the radiating elements 25 as a result of being fed energy by way of the modular means to be directed normal to a planar phase front induced by the phase-shifters. The phase front is controlled in the usual manner by adjusting the phase-shift induced by each phase-shifter 37. This function is usually controlled by a computer 41. As shown in FIG.

1, a radar system using the lens antenna 11 may be of a conventional type, with phase-shifters 37 controlled by the computer 41 and with a transmitter 43 and a receiver 45 connected to the feed horns through a duplexer 47.

Figure 2:
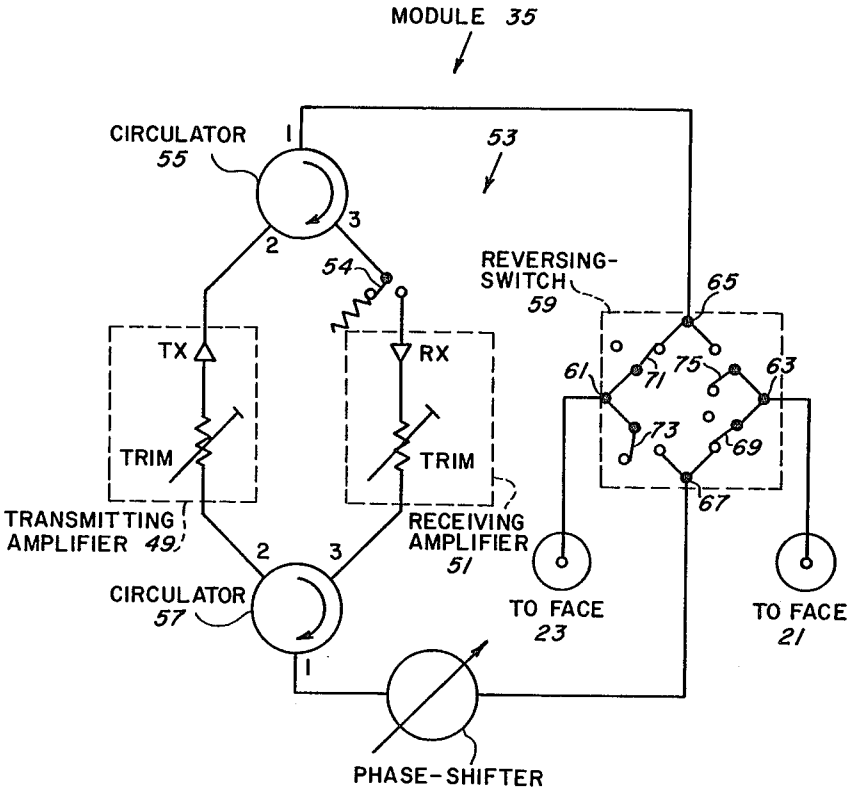
FIG. 2 is a diagrammatic view of an embodiment of a modular means, for use in the lens antenna of this invention.

While each modular means 35 may take a variety of forms, conveniently it may take the form shown in FIG. 2, of a solid-state module containing a transmitting amplifier 49, a receiving amplifier 51, a diode phase-shifter 37, and a routing-means 53. The amplifiers may comprise, for example, transistor chains and associated trimmers. The routing means 53 is employed to collect energy and provide a selectively closable path for the collected energy through the phase-shifter 37 and the transmitting amplifier 49 from energized radiating elements 25 on one face (e.g. 21) of the lens to the radiating elements on the other face (e.g. 23) of the lens to form an antenna beam 26 and through the receiving amplifier 51 and phase-shifter from energized radiating elements on the other face (e.g. 23) of the lens to the radiating elements on the one face (e.g. 21) of the lens when intercepting an antenna beam. Alternatively, the routing means 53 is employed to collect energy and provide a selectively closable path for the collected energy through the phase-shifter 37 and the transmitting amplifier 49 from the energized radiating elements 25 on the other face (e.g. 23) of the lens to the radiating elements on the one face (e.g. 21) of the lens to form an antenna beam 55 and through the receiving amplifier 51 and phase-shifter from energized radiating elements on the one face (e.g. 21) of the lens to the radiating elements on the other face (e.g. 23) of the lens when intercepting an antenna beam. While the routing-means 53 may take a variety of forms, conveniently it may take the form shown in FIG. 2 of a diode switch 54 connected in series with the receiving amplifier 51, a pair of three-port circulators 55 and 57, and a diode reversing-switch 59 having a first pair of contacts 61 and 63 respectively connected to the two faces 21 and 23 of the lens, and a second pair of contacts 65 and 67 connected respectively to a first port of the circulator 55, and by way of the phase-shifter 37 to a first port of the circulator 57. The pair of circulators 55 and 57 have respective second ports interconnected by the transmitting amplifier 49 and respective third ports interconnected by the series combination of the receiving amplifier 51 and the switch 54. The reversing-switch itself may comprise, for example, a switch 69 connected by the phase-shifter 37 between face 21 of the lens and the first port of the circulator 57; a switch 71 connected between the first port of the circulator 55 and face 23 of the lens; a switch 73 connected by the phase-shifter between the face 23 of the lens and the first port of the circulator 57; and a switch 75 connected between the first port of the circulator 55 and the face 21 of the lens.

The positioning of the switches 54, 69, 71, 73, 75 is controlled by the computer 41.

Referring again to FIG. 1, in operation, the computer 41 determines the quadrant of space and the desired phase-shift for a given beam-pointing direction by antenna 11. Then the computer 41 performs the following tasks. The component switches 69, 71, 73, 75 of the reversing-switch 59 must assume the correct position for transmission of energy from the other face of the lens to the face scanning the desired quadrant of space. In the following discussion, it will be assumed that energy transmission is from face 21 to face 23 so that the shown positions of the switches 69, 71. 73, 75 are the correct ones i.e., switches 69 and 71 closed; switches 73 and 75 open. Also, the phase-shift induced by each phase-shifter 37 is adjusted to the correct value to steer the beam 26. Also switch 54 is opened. After these tasks have been performed, the computer 41 turns on the transmitter 43 which activates the feed horn 31 on the other side of the lens 17 from the quadrant of space to be scanned. and the feed horn 31 energizes the set of radiating elements 25 on the face 21 adjacent to it. Each modular means 35 (shown in more detail in FIG. 2) responds to the energizing of its associated radiating element 25 by feeding the energy through its closed switch 69 and its phase-shifter 37 to the first port of its circulator 57. The phase-shifted energy entering the first port of the circulator 57 is transmitted to the next adjacent port, which is its second port, and fed through the transmitting amplifier 49 (whose gain has been preset) to the second port of the circulator 55. The amplified energy entering the second port of the circulator 55 is transmitted to the next adjacent port, which is its first port, and fed through the closed switch 71 to the associated radiating element 25 on the face 23 of the lens on the side of the quadrant of space to be scanned. The second set of radiating elements 25 then forms an antenna beam 26 in a direction normal to a planar phase front induced by the phase-shifters 37.

To receive the return beam, the computer 41 turns off the transmitter 43, turns on the receiver 45, and closes the switch 54 that is connected in series with the receiving amplifier 51. When the second set of radiating elements 25 is energized by the intercepted return beam, each modular means 35 responds to the energizing of its associated radiating element 25 by feeding the energy through its closed switch 71 to the first port of the circulator 55. The energy entering the first port of the circulator 55 is transmitted to the next adjacent port, which is the third port, and fed through the closed switch 54 and the receiving amplifier 51 (whose gain has been preset) to the third port of the circulator 57. The amplified energy entering the third port of the circulator 57 is transmitted to the next adjacent port, which as its first port, and fed through the phase-shifter 37 and the closed switch 69 to the associated radiating element 25 on the face 21 of the lens on the other side from the scanned quadrant of space. The first set of radiating elements 25 then re-radiate the collected energy so as to focus it in the adjacent feed horn 31, from which it is passed to the receiver 45.

It is obvious that many modifications and variations of the present invention are possible in light of the above teachings. For example. multiple feed horns may be used for separately optimizing the transmit and receive energy distributions at the lens faces, e.g. for high efficiency and low sidelobes respectively and added simplification of transmit and receive separation. Further, wide instantaneous bandwidth may be obtained by equalizing the path lengths from the feed horns through the lens to the beam-forming face of the lens. Even wider instantaneous bandwidth may be obtained with the known technique of using several feeds. The transmission lines connecting the faces and modules may take several forms, e.g. may be coaxial cable or stripline. For ground application, only one half of the described system (for example, 11) may be adequate, giving at least 180° of radar coverage. It is therefore to be understood that within the scope of the appended claims, the invention may be practiced otherwise than as described.

What is claimed as new and desired to be secured by Letters Patent of the United States is:

1. A lens antenna configured to have ample and readily accessible space for components and to be amenable to cooling, comprising:

a lens having a pair of faces disposed substantially at a right angle to each other but tilted back;

a set of radiating elements on each of the faces, each set of radiating elements being adapted to form antenna beams when energized;

feed system means for energizing the sets of radiating elements;

a pair of feed horns, one feed horn adjacent each face of the lens for energizing the respective set of radiating elements; and an array of modular means interconnecting the radiating elements on one face of the lens with the radiating elements on the other face of the lens and responsive to the energizing of the radiating elements on one of the faces for collecting the energy from the radiating elements on the one face and for feeding the collected energy to the radiating elements on the other face.

2. In combination with the lens antenna recited in claim 1:

a second lens antenna as recited in claim 1, the second lens antenna being positioned back-to-back with the first lens antenna, in order to scan 360° in azimuth.

3. The lens antenna recited in claim 1 wherein each of the module means includes:

a controllable phase-shifter for causing the antenna beams to be formed in a direction normal to an induced phase front.

4. The lens antenna recited in claim 3 wherein each of the module means includes:

a transmitting amplifier.

5. The lens antenna recited in claim 4 wherein each of the module means includes:

a receiving amplifier.

6. A lens antenna configured to have ample and readily accessible space for components and to be amenable to cooling, comprising:

a lens having a pair of faces disposed substantially at a right angle to each other but tilted back;

a set of radiating elements on each of the faces, each set of radiating elements being adapted to form antenna beams when energized;

a pair of feed horns, one feed horn adjacent each face of the lens for energizing the respective set of radiating elements; and an array of modular means interconnecting the radiating elements on one face of the lens with the radiating elements on the other face of the lens, each modular means including, a controllable phase-shifter for causing the antenna beams to be formed in a direction normal to an induced phase front;

a transmitting amplifier;

a receiving amplifier;

routing means for collecting energy and providing a selectively closable path for the collected energy through the transmitting amplifier and phase-shifter from energized radiating elements on one face of the lens to the radiating elements on the other face of the lens to form an antenna beam and through the receiving amplifier and phase-shifter from energized radiating elements on the other face of the lens to the radiating elements on the one face of the lens when intercepting an antenna beam, and for collecting energy and providing a selectively closable path for the collected energy through the transmitting amplifier and phase-shifter from energized radiating elements on the other face of the lens to the radiating elements on the one face of the lens to form an antenna beam and through the receiving amplifier and phase-shifter from energized radiating elements on the one face of the lens to the radiating elements on the other face of the lens when intercepting an antenna beam.

7. In combination with the lens antenna recited in claim 6:

a second lens antenna as recited in claim 6, the second lens antenna being positioned back-to-back with the first lens antenna, in order to scan 360° in azimuth.

8. The lens antenna recited in claim 6 wherein the routing means includes:

a pair of three-port circulators.

9. The lens antenna recited in claim 8 wherein the routing means includes:

a reversing-switch having a first pair of contacts respectively connected to the two faces of the lens and a second pair of contacts connected respectively to a first port of one of the circulators and by way of the phase-shifter to a first port of the other circulator.

10. The lens antenna recited in claim 9 wherein the routing means includes:

a first switch connected in series with the receiving amplifier.

11. The lens antenna recited in claim 10 wherein:

the pair of three-port circulators have respective second ports interconnected by the transmitting amplifier and respective third ports interconnected by the series combination of the receiving amplifier and the first switch.

12. The lens antenna recited in claim 11 wherein the reversing switch includes:

a second switch connected by the phase-shifter between one face of the lens and the first port of the other circulator.

13. The lens antenna recited in claim 12 wherein the reversing-switch includes;

a third switch connected between the first port of the one of the circulators and the other face of the lens.

14. The lens antenna recited in claim 13 wherein the reversing switch includes:

a fourth switch connected by the phase-shifter between the other face of the lens and the first port of the other circulator.

15. A lens antenna configured to have ample and readily accessible space for components and to be amenable to cooling, comprising:

a lens having a pair of faces disposed substantially at a right angle to each other but tilted back;

a set of radiating elements on each of the faces, each set of radiating elements being adapted to form antenna beams when energized;

a pair of feed horns, one feed horn adjacent each face of the lens for energizing the respective set of radiating elements; and an array of modular means interconnecting the radiating elements on one face of the lens with the radiating elements on the other face of lens, each modular means including;

a controllable phase-shifter for causing the antenna beams to be formed in a direction normal to an induced phase front;

a transmitting amplifier;

a receiving amplifier;

a first switch in series with the receiving amplifier;

a pair of three-port circulators, a second switch connected by the phase-shifter between one face of the lens and a first port of one of the circulators;

a third switch connected between a first port of the other circulator and the other face of the lens;

a fourth switch connected by the phase-shifter between the other face of the lens and the first port of the one circulator;

a fifth switch connected between the first port of the other circulator and the one face of the lens;

a pair of three-port circulators having respective second ports interconnected by the transmitting amplifier and respective third ports interconnected by the series combination of the receiving amplifier and the first switch.

16. In combination with the lens antenna recited in claim 15:

a second lens antenna as recited in claim 15, the second lens antenna being positioned back-to-back with the first lens antenna, in order to scan 360° in azimuth.

* * * * *